US009226564B1

(12) United States Patent
Cross

(10) Patent No.: US 9,226,564 B1
(45) Date of Patent: Jan. 5, 2016

(54) SURFBOARD BAG HAMMOCK

(71) Applicant: Kevin Cross, Cocoa, FL (US)

(72) Inventor: Kevin Cross, Cocoa, FL (US)

( * ) Notice: Subject to any disclaimer, the term of this patent is extended or adjusted under 35 U.S.C. 154(b) by 45 days.

(21) Appl. No.: 14/168,742

(22) Filed: Jan. 30, 2014

(51) Int. Cl.

| | |
|---|---|
| ***A45F 3/22*** | (2006.01) |
| ***A45F 4/08*** | (2006.01) |
| ***B63B 35/79*** | (2006.01) |
| ***B63B 35/85*** | (2006.01) |
| *A45F 4/02* | (2006.01) |

(52) U.S. Cl.
CPC ... *A45F 3/22* (2013.01); *A45F 4/08* (2013.01); *B63B 35/79* (2013.01); *B63B 35/85* (2013.01); *A45F 4/02* (2013.01); *A45F 2004/023* (2013.01)

(58) Field of Classification Search
CPC ..... A45F 3/22; A45F 4/08; A45F 4/02; A45F 2004/023; B63B 35/79; B63B 35/85
See application file for complete search history.

(56) References Cited

U.S. PATENT DOCUMENTS

| | | | | |
|---|---|---|---|---|
| 5,913,772 | A * | 6/1999 | Clark | 5/121 |
| 7,178,182 | B2 * | 2/2007 | Brenner et al. | 5/413 R |
| 2007/0277310 | A1 * | 12/2007 | Sanford-Schwentke | 5/128 |
| 2009/0265851 | A1 * | 10/2009 | Clark | 5/122 |
| 2013/0146633 | A1 * | 6/2013 | Sesoko | 224/576 |
| 2014/0158174 | A1 * | 6/2014 | Rhett, Jr. | 135/121 |

* cited by examiner

*Primary Examiner* — David E Sosnowski
(74) *Attorney, Agent, or Firm* — Michael I. Kroll

(57) ABSTRACT

A surfboard bag hammock that is configured as a carrier receptacle and a hammock by having two different sized layers of material fastened together. The larger layer of material serves as the hammock and the smaller layer of material having a fastener lined opening serves as the carrier receptacle for an article, such as a surfboard. When the carrier receptacle is turned inside out the hammock is inserted and used as packing material before the article is placed within the carrier receptacle.

1 Claim, 10 Drawing Sheets

SURFBOARD BAG HAMMOCK

BACKGROUND OF THE INVENTION

1. Field of the Invention

The present invention relates generally to carryalls and, more specifically, to a surfboard bag hammock that can be configured either as an article carrier or as a hammock by having two dissimilarly sized pieces of material fastened together forming a compartment there between with the larger material serving as hammock and the smaller material having a fastener lined opening serving as storage for an article placed therein with the novel element that when the article compartment is turned inside out the extra hammock material serves as padding and protection for the article within the article receptacle.

2. Description of the Prior Art

There are other carriers which provide for articles. While these carriers may be suitable for the purposes for which they where designed, they would not be as suitable for the purposes of the present invention as heretofore described.

SUMMARY OF THE PRESENT INVENTION

A primary object of the present invention is to provide a surfboard bag hammock that can be used as an article carrier or as a hammock.

Another object of the present invention is to provide a surfboard bag hammock comprising a first layer of material and a second layer of material of smaller dimension than the first fixedly attached to the first layer of material.

Yet another object of the present invention is to provide a surfboard bag hammock wherein said first layer of material has opposing ends that are folded and fastened to create opposing end channels for placement therein of lines, such as cord, that serve as means for attachment of the hammock to supports.

Still yet another object of the present invention is to provide a surfboard bag hammock wherein said second layer of material, preferably of an ovoid shape, is fixedly attached to the first layer of material approximate the center of the first thereby forming a compartment between the first and second layers of material.

Another object of the present invention is to provide a surfboard bag hammock where a longitudinal slit is made in the ovoid material layer thereby forming access to said compartment forming article receptacle.

Yet another object of the present invention is to provide a surfboard bag hammock further comprising a mating fastener fixedly attached to the slit edges providing means of closure for said article receptacle.

Still yet another object of the present invention is to provide a surfboard bag hammock that when the article receptacle is turned inside out the excess hammock material now with the article receptacle serves as packing material and protection for an article placed within the article receptacle.

Additional objects of the present invention will appear as the description proceeds.

The present invention overcomes the shortcomings of the prior art by providing a surfboard bag hammock that can be configured as either a hammock or an article carrier simply by turning the article carrier inside out, then attaching the hammock lines or cord to spaced apart supports where then the article carrier is on the user side of the hammock. To configure as an article carrier the article carrier is turned inside out where then the hammock material will be within the article carrier serving as packing material and protection for articles within.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
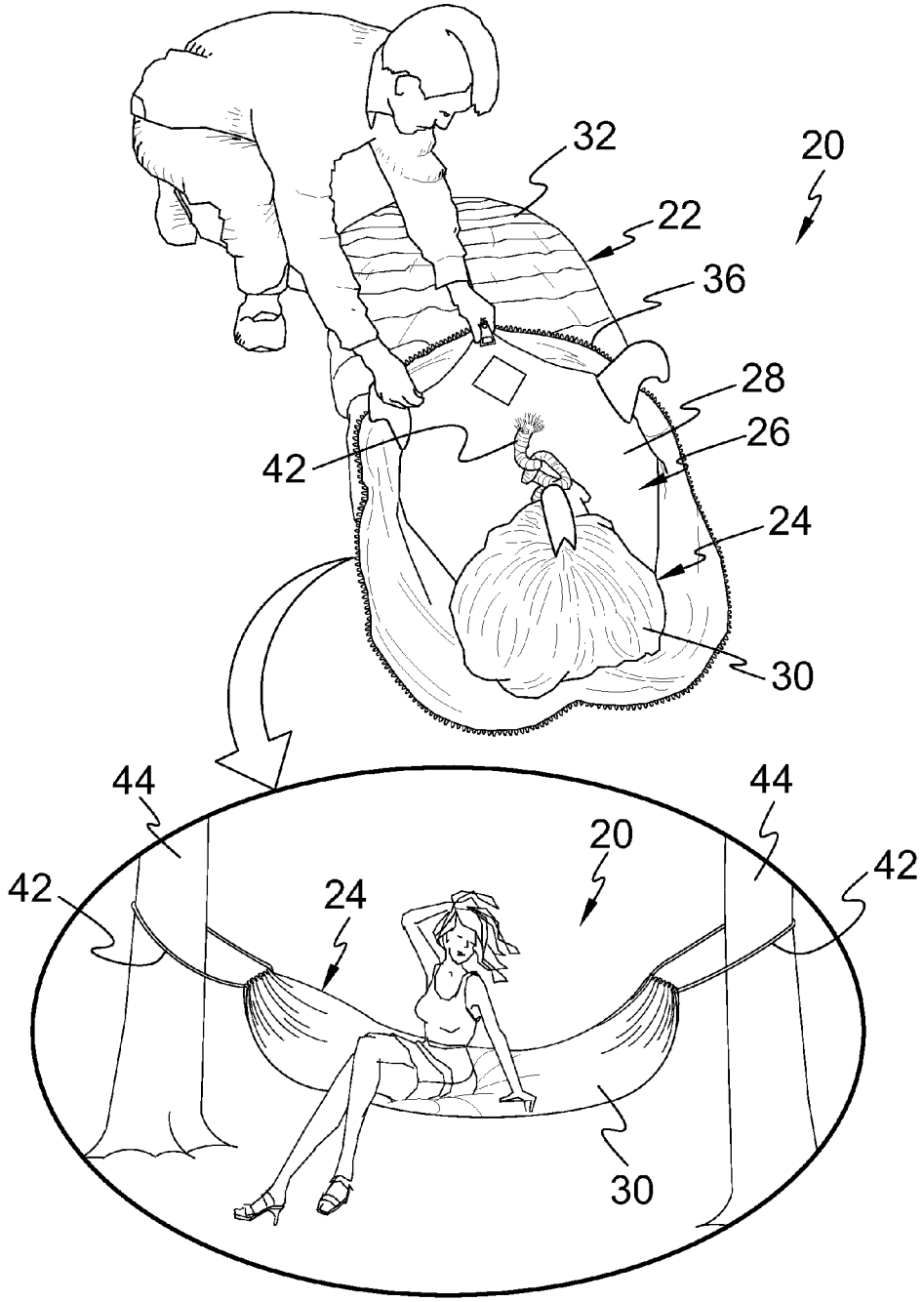
FIG. 1 is an illustrative view of the surfboard bag hammock of the present invention.

Turning now descriptively to the drawings, in which similar reference characters denote similar elements throughout the several views, the Figures illustrate the surfboard bag hammock of the present invention. With regard to the reference numerals used, the following numbering is used throughout the various drawing figures.

20 surfboard bag hammock
22 article carrier receptacle of surfboard bag hammock 20
24 hammock of surfboard bag 20
26 article in article carrier receptacle 22
28 surfboard for article 26
30 rectangular layer of material for hammock 24
32 ovoid layer of material for article carrier receptacle 22
34 longitudinal slit in ovoid layer of material 32
36 zipper in longitudinal slit 34
38 end of rectangular layer of material 30
40 channel in end 38

42 line in channel 40
44 support for line 42

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of the surfboard bag hammock of the present invention. The surfboard bag hammock 20 of the present invention provides an article carrier receptacle 22 that is attached to a hammock 24. When used as the article carrier receptacle 22, the hammock 24 will fold into the article carrier receptacle 22 serving as packing material for an article 26 stored within the article carrier receptacle 22. When used as the hammock 24 the article carrier receptacle 22 is turned inside out. for illustrative purposes, the article 26 carried is shown as a surfboard 28 but is not limited to such as there are many other types of boards, such as long boards, paddle boards, boogie boards, etc.

Figure 2:
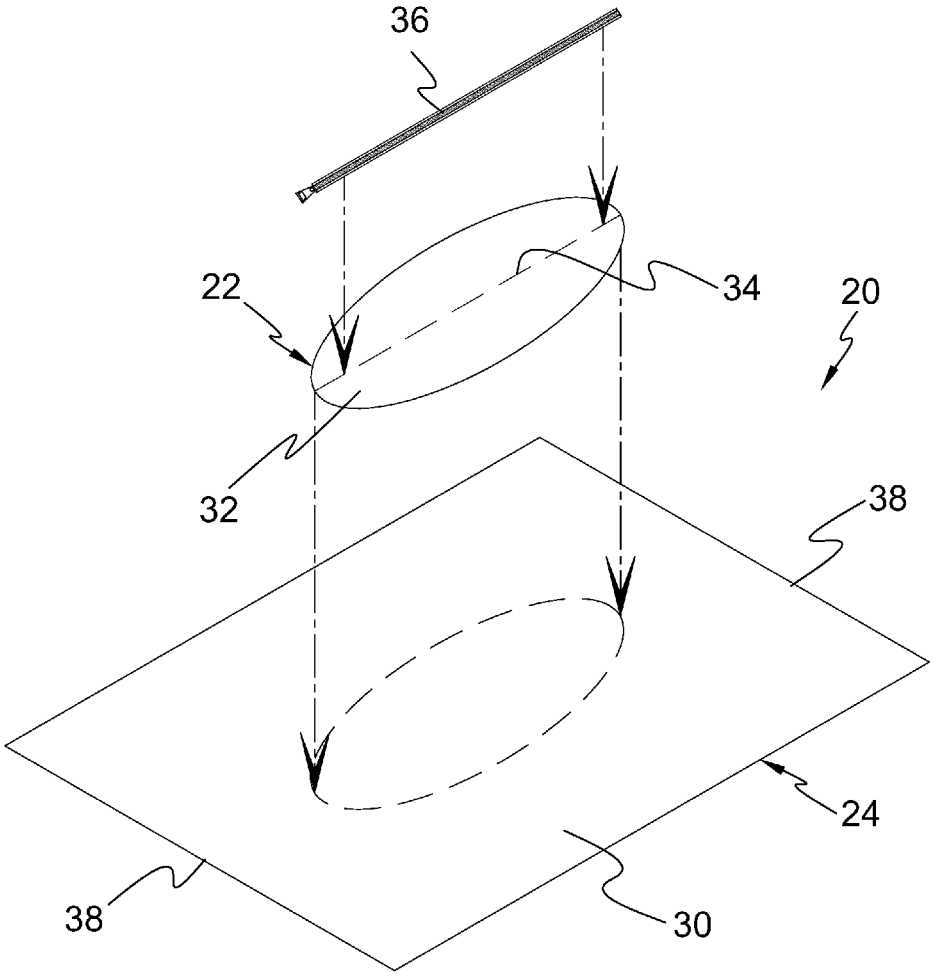
FIG. 2 is an exploded view of the surfboard bag hammock of the present invention.

Referring to FIG. 2, shown is an exploded view of the surfboard bag hammock of the present invention. The surfboard bag hammock 20 comprises a rectangular layer of material 30 that serves as the hammock 24 and an ovoid layer of material 32 that serves as the article carrier receptacle 22. The ovoid layer of material 32 has a longitudinal slit 34 with a zipper 36 fixedly attached to edges of the slit 34 forming a way for closure of the ovoid layer of material 32 that forms the article carrier receptacle 22.

Figure 3:
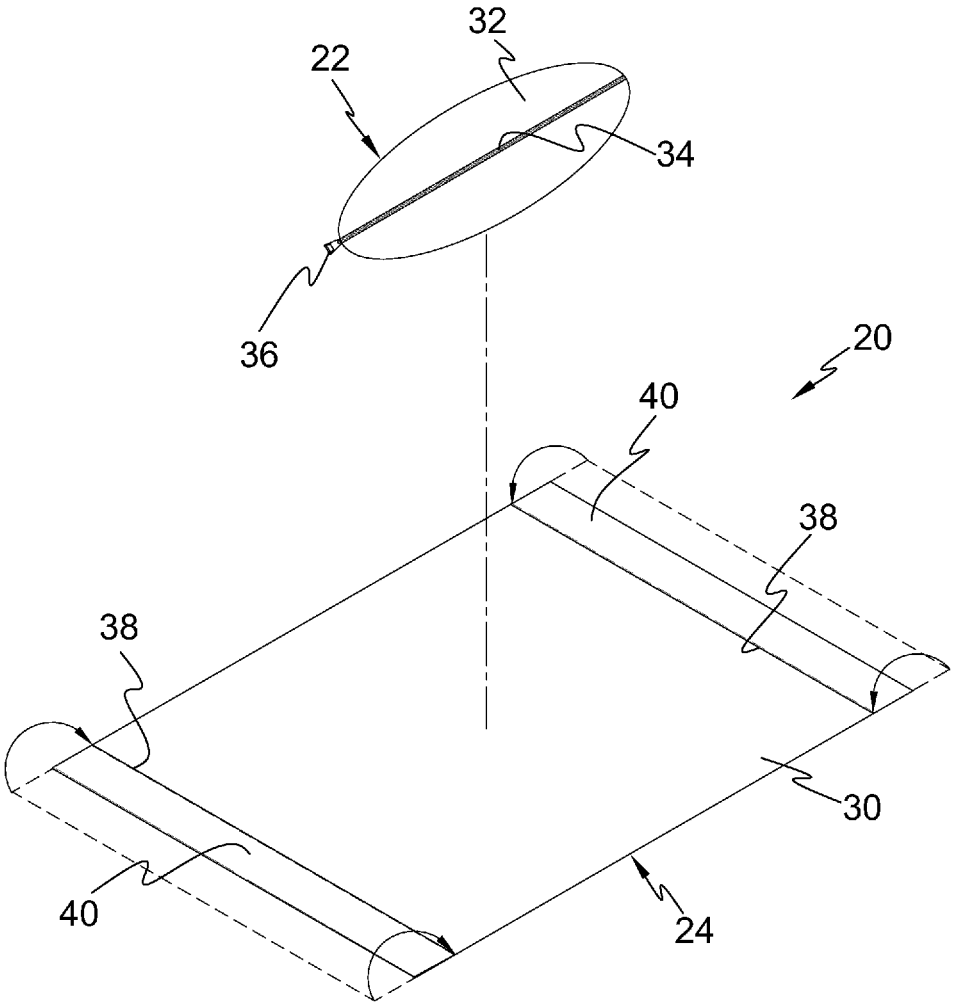
FIG. 3 is a partially assembled view of the surfboard bag hammock of the present invention.

Referring to FIG. 3, shown is a partially assembled view of the surfboard bag hammock of the present invention. Each of the ends 28 of the rectangular layer material 30 is folded and fastened creating a channel 40 for a line 42 that will provide a way for attaching the hammock 24 to spaced apart supports 44.

Figure 4:
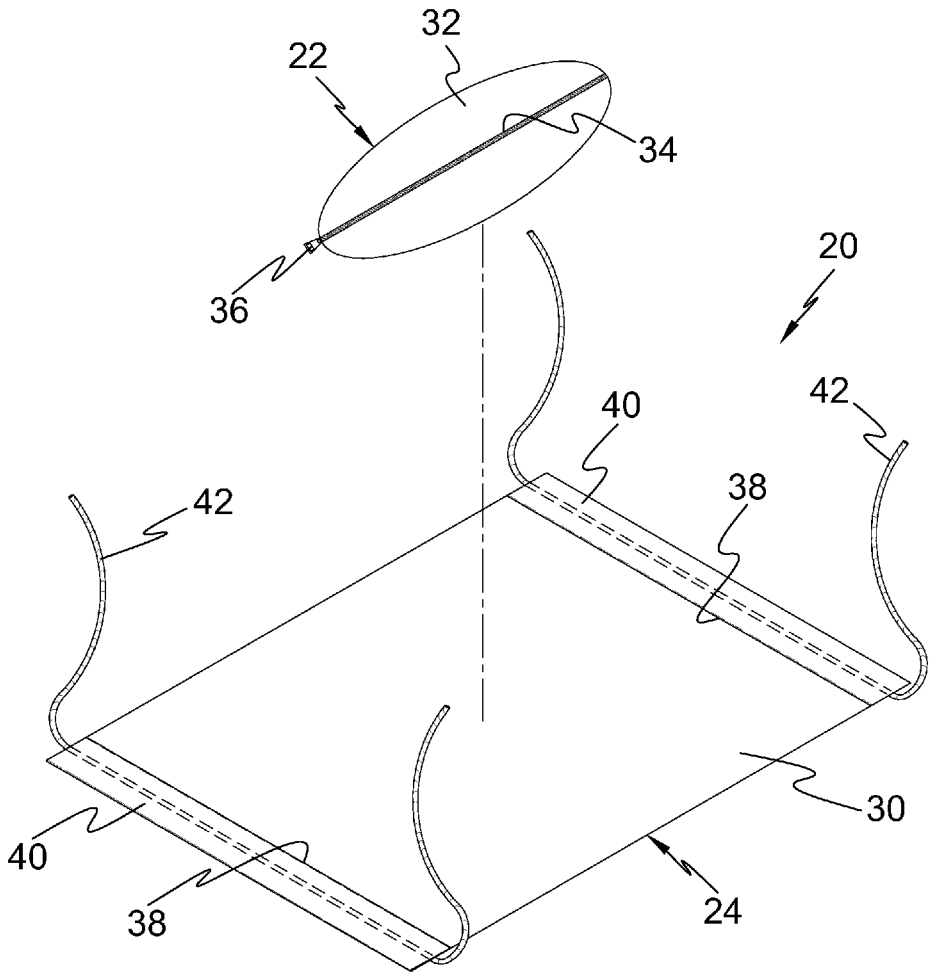
FIG. 4 is another partially assembled view of the surfboard bag hammock of the present invention.

Referring to FIG. 4, shown is another partially assembled view of the surfboard bag hammock of the present invention. Shown is the rectangular layer of material 30 with lines 42 extending through the channels 40 providing a way for attaching the hammock 24 to the supports 44.

Figure 5:
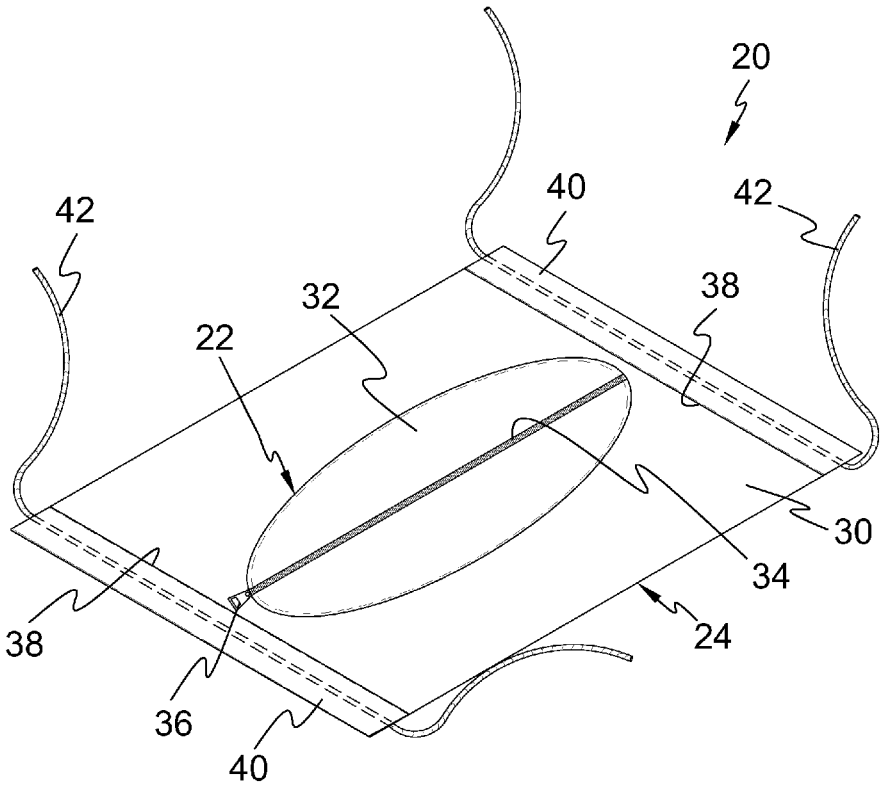
FIG. 5 is an assembled view of the surfboard bag hammock.

Referring to FIG. 5, shown is an assembled view of the surfboard bag hammock. Depicted is the assembled surfboard bag hammock 10 of the present invention comprising the article carrier receptacle 22 formed by fastening the ovoid layer of material 32 to the rectangular layer of material 30. The article carrier receptacle 22 has the longitudinal zipper 36 providing access to the article carrier receptacle 22 formed by fastening the ovoid layer of material 32 to the rectangular layer of material 30.

Figure 6:
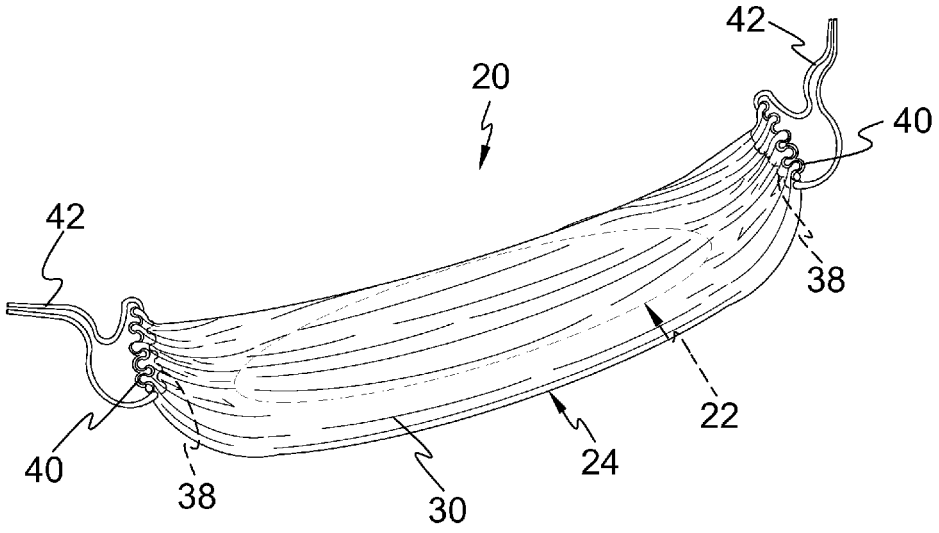
FIG. 6 is a perspective view of the surfboard bag hammock of the present invention.

Referring to FIG. 6, shown is a perspective view of the surfboard bag hammock of the present invention. Shown are the hammock lines 42 pulling the channels 40 on the ends 38, forming the hammock 24 with the article carrier receptacle 22 on the underside of the hammock 24.

Figure 7:
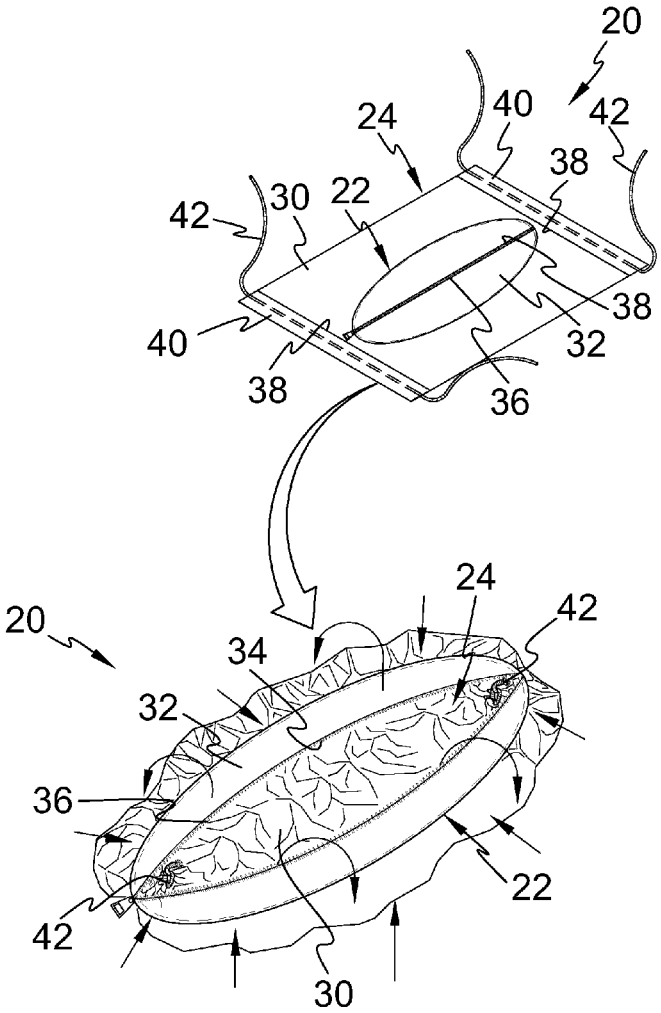
FIG. 7 is a perspective view of the surfboard bag hammock of the present invention.

Referring to FIG. 7, shown is a perspective view of the surfboard bag hammock of the present invention. To use the surfboard bag hammock 20 as the article carrier receptacle 22, the article carrier receptacle 22 is turned inside out so that the rectangular layer of material 30 is inside the article carrier receptacle 22 where then the rectangular layer of material 30 serves as packing material and protection for articles 26 placed therein.

Figure 8:
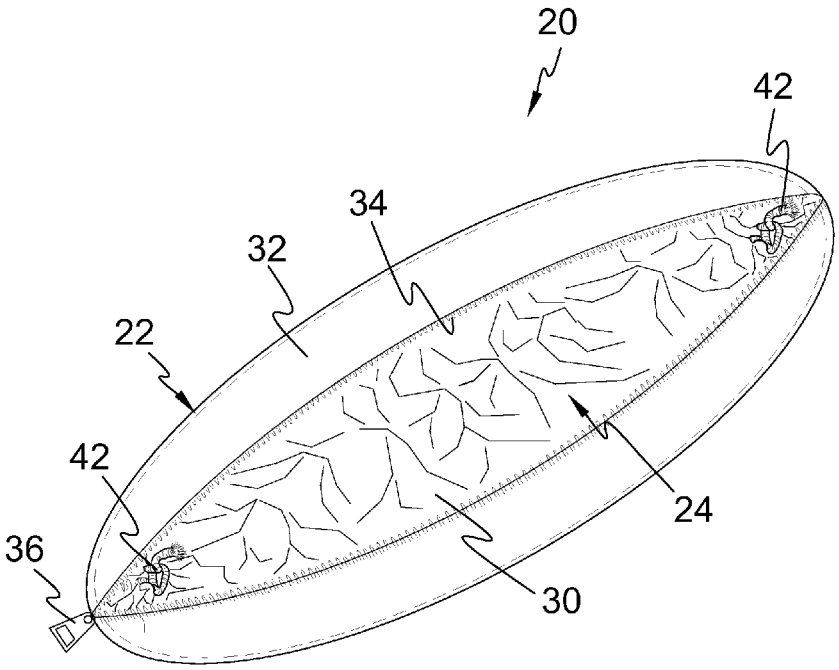
FIG. 8 is a perspective view of the surfboard bag hammock of the present invention.

Referring to FIG. 8, shown is a perspective view of the surfboard bag hammock of the present invention. Shown is the rectangular layer of material 30 within the article carrier receptacle 22.

Figure 9:
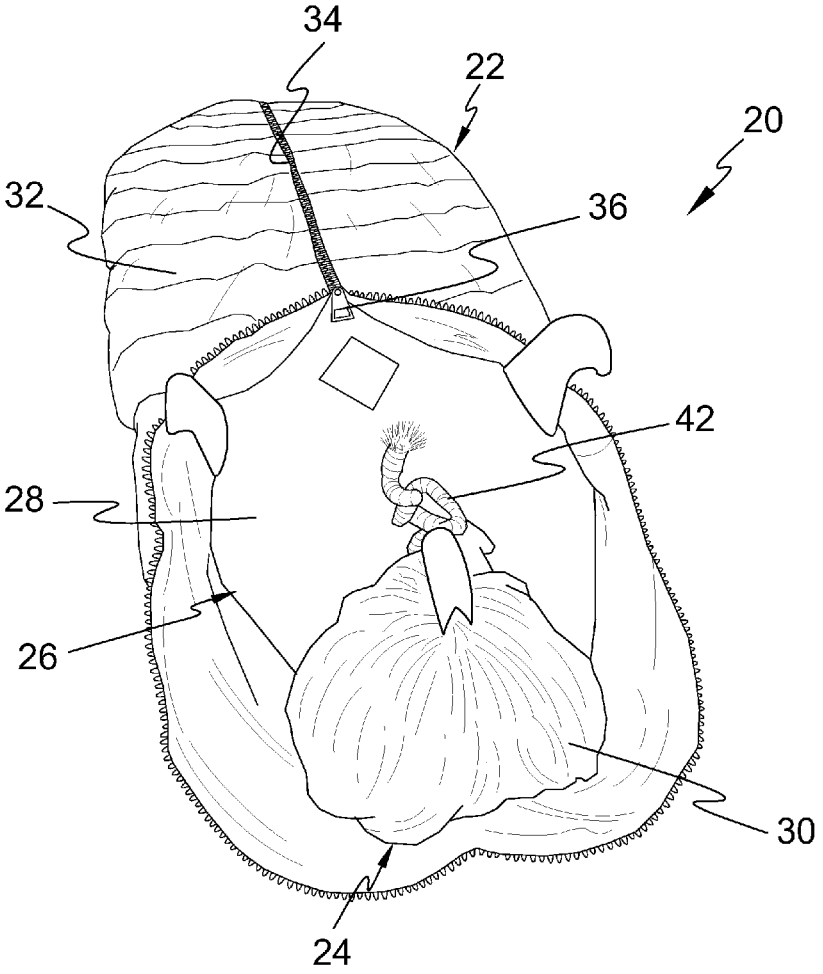
FIG. 9 is a perspective view of the surfboard bag hammock of the present invention in use.

Referring to FIG. 9, shown is a perspective view of the surfboard bag hammock of the present invention in use. Once the surfboard bag hammock 20 has been configured into the article carrier receptacle 22, the article 26, such as the surfboard 28, can be placed within the article carrier receptacle 22 where the rectangular layer of material 30 and hammock lines 42 can be used as packing material to further protect the article 26 or articles placed therein.

Figure 10:
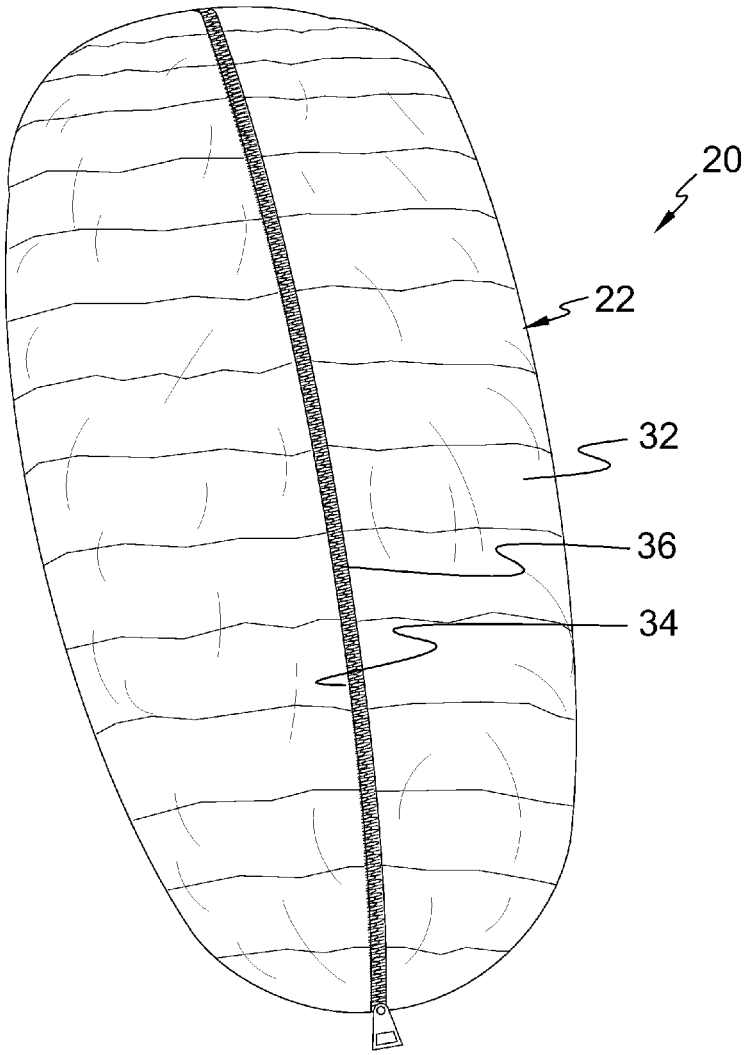
FIG. 10 is a perspective view of the surfboard bag hammock.

Referring to FIG. 10, shown is a perspective view of the surfboard bag hammock. Shown is the surfboard bag hammock 20 used as an article carrier receptacle 22 for articles 26 such as the surfboard 28, long board, paddle board, etc, with the rectangular layer of material 30 serving as packing material for articles 26 within the article carrier receptacle 22

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed is new and desired to be protected by Letters Patent and is set forth in the appended claims:

1. A method for constructing a surfboard bag hammock comprising the steps of:

a) providing a rectangular layer of material configured to be used as a hammock;
b) folding over opposing free transverse ends of the rectangular layer of material;
c) fastening the folded free ends to the rectangular layer of material to form channels;
d) extending a line through each channel, each line being configured to attach the hammock to spaced apart supports;
e) providing an ovoid layer of material having a longitudinal slit and being devoid of additional openings, the longitudinal slit extending along a centerline of the ovoid layer of material from one terminal end of the ovoid layer of material to an opposing terminal end of the ovoid layer of material, wherein the terminal ends are located immediately adjacent to the channels;
f) fixedly attaching a zipper to opposing edges of the longitudinal slit, the zipper being configured as a closure for the ovoid layer of material;
g) fastening the ovoid layer of material to an underside of the rectangular layer of material such that the zippered ovoid layer of material forms a carrier receptacle located underneath the rectangular layer of material when the hammock is in use and is attached to the spaced apart supports;
h) opening the zipper;
i) turning the ovoid layer of material inside out;
j) inserting the rectangular layer of material and the lines into the carrier receptacle formed by the ovoid layer and the zipper such that the rectangular layer of material and the lines serve as packing material and protection for articles placed into the carrier receptacle;

k) placing an article into the carrier receptacle; and l) closing the zipper.

* * * * *